US005115936A

United States Patent [19]

Bartlow

[11] Patent Number: 5,115,936

[45] Date of Patent: May 26, 1992

[54] DOUBLE WALL UNDERGROUND STORAGE TANK

[75] Inventor: David H. Bartlow, Conroe, Tex.

[73] Assignee: Owens-Corning Fiberglas Corporation, Toledo, Ohio

[21] Appl. No.: 644,511

[22] Filed: Jan. 23, 1991

[51] Int. Cl.[5] ..... B65D 90/04

[52] U.S. Cl. ..... 220/426; 220/445; 220/469; 73/492

[58] Field of Search ..... 220/426, 565, 413, 466, 220/469, 669, 675, 445; 138/148, 173; 405/53, 55; 73/49.2

[56] References Cited

U.S. PATENT DOCUMENTS

| | | | |
|---|---|---|---|
| 4,552,166 | 11/1985 | Chadborne, Sr. et al. | 220/426 X |
| 4,561,292 | 12/1985 | Pugnale et al. | 220/426 X |
| 4,676,093 | 6/1987 | Pugnale et al. | 73/49.2 |
| 4,739,659 | 4/1988 | Sharp | 73/49.2 |
| 4,778,075 | 10/1988 | Wiegand et al. | 220/71 |
| 4,781,777 | 11/1988 | Pugnale et al. | 220/426 X |
| 4,869,386 | 9/1989 | Sharp | 220/469 X |
| 4,875,361 | 10/1989 | Sharp | 220/445 X |
| 4,923,081 | 5/1990 | Weaver et al. | 220/72 |
| 4,925,046 | 5/1990 | Sharp | 220/469 X |
| 4,936,705 | 6/1990 | Schneider | 220/426 X |
| 4,995,528 | 2/1991 | Sharp | 220/469 X |
| 5,017,044 | 5/1991 | Sharp | 220/4.13 X |
| 5,020,358 | 6/1991 | Sharp | 220/445 X |

*Primary Examiner*—Steven M. Pollard
*Attorney, Agent, or Firm*—Patrick P. Pacella; Ted C. Gillespie

[57] ABSTRACT

An underground storage tank has an inner wall and an outer wall defining a generally annular space for receiving a leak detecting fluid, and a plurality of ribs bonded to the inner and outer walls and projecting radially outwardly from the inner wall, each rib comprising sidewalls and a top wall, the outer wall being attached to the top wall of each rib but substantially unattached to the sidewalls of each rib, and the outer wall substantially conforming to the contour of the inner wall and the ribs.

22 Claims, 4 Drawing Sheets

DOUBLE WALL UNDERGROUND STORAGE TANK

TECHNICAL FIELD

This invention relates to underground storage tanks suitable for storing liquids. More particularly, this invention relates to double wall underground storage tanks adapted to contain leak detecting liquids between the walls.

BACKGROUND ART

Underground storage tanks, which are typically made of fiberglass reinforced plastic, are well known in the art. Such tanks are commonly used to store gasolines and other fuels, as well as corrosive liquids. Typically, these tanks have a plurality of spaced-apart ribs around the circumference of the generally cylindrical tank. Recent innovations in such underground tanks include the development of a double wall tank. Double wall tanks provide a double barrier to prevent leakage of the liquids from the tank. Also, the annular space between the inner and outer walls can be filled with a leak detecting fluid which can be monitored to detect leaks in the tank's inner or outer wall. As disclosed in U.S. Pat. No. 4,676,093 to Pugnale et al., the annular space between the inner and outer tank walls can be connected to the hollow ribs in order to form a leak detecting space between the inner and outer walls.

One of the problems with previous designs for double wall tanks is that the outer layer is spaced apart a considerable distance from the inner layer, thereby creating a large volume in the void or annular space between the outer and inner walls. This space is generally defined by the height of the ribs, since the double wall tank is usually made by superimposing an outer wall over the ribs of a ribbed single wall tank. Since the void space or annular space is so large, a large volume of leak detecting fluid is required in order to operate the tank leak detection system. This leak detection fluid is expensive and it would be desirable to provide a tank having a smaller volume in the annular space between the inner and outer tank walls.

Another problem caused by the fact that the outer tank wall of previous designs is spaced apart from the inner tank wall by the height of the rib, is the fact that the resulting double wall tank is considerably larger in gross exterior volume than previously employed single wall tanks. These large double wall tanks, when installed in a replacement operation, such as in a gasoline service station, result in the need for a larger excavation for installation of the new double wall tank. The larger excavation results in a considerable amount of excess soil which must be removed from the excavation and disposed of. Such removed soil is considered "contaminated" by most environmental regulations, and disposal of such excess soil is expensive.

It would be desirable to provide a double wall tank in which the void space or annular space is reduced from that of previous designs, and in which the outer wall dimension does not greatly exceed the dimension of existing single wall tanks.

DISCLOSURE OF THE INVENTION

There is now provided a new underground storage tank in which the outer wall is attached to the top wall of the ribs, but still substantially conforms to the contour of the inner wall and the ribs. This enables the storage tank to provide a leak detecting space, while minimizing the void space within the annular leak detecting space. Further, since the outer wall follows the contour of the ribs and inner wall the exterior dimension of the tank is minimized.

According to this invention there is provided an underground storage tank having an inner wall and an outer wall defining a generally annular space between the inner and outer walls for receiving a leak detecting fluid, and a plurality of ribs bonded to the inner and outer walls and projecting radially outwardly from the inner wall, each rib comprising sidewalls and a top wall, the outer wall being attached to the top wall of each rib but substantially unattached to the sidewalls of each rib, and the outer wall substantially conforming to the contour of the inner wall and the ribs. Preferably, the ribs are hollow, and the interior portions of the ribs are in communication with the annular space so that the leak detecting fluid can flow freely from the annular space to the interior of the ribs.

In a specific embodiment of the invention a fibrous mat is positioned between the inner wall and the outer wall, and the annular space has a Width substantially equal to the thickness of the mat for those portions of annular space which are between the ribs. The mat can be any type of mat which is suitable for maintaining the separation between the inner and outer walls so that a void for the flow of a leak detecting fluid can be created. Preferably, a film is attached to one side of the mat. The mat prevents bonding of the inner wall to the outer wall.

In another specific embodiment of the invention, the annular space along the rib sidewalls has a width substantially equal to the thickness of the mat.

In another specific embodiment of the invention, the rib has rounded corners. In yet another specific embodiment of the invention, the rib has sharp corners.

In an additional embodiment of the invention, the rib top wall forms a concave surface in the interior portion of the rib.

In yet another embodiment of the invention, the rib top wall forms a convex surface in the interior portion of the rib.

In a specific embodiment of the invention, the annular space extends along the rib sidewalls and partway across the rib top wall.

In yet another specific embodiment of the invention, the annular space extends along the rib sidewalls and completely across the top wall.

BEST MODE FOR CARRYING OUT THE INVENTION

Figure 1:
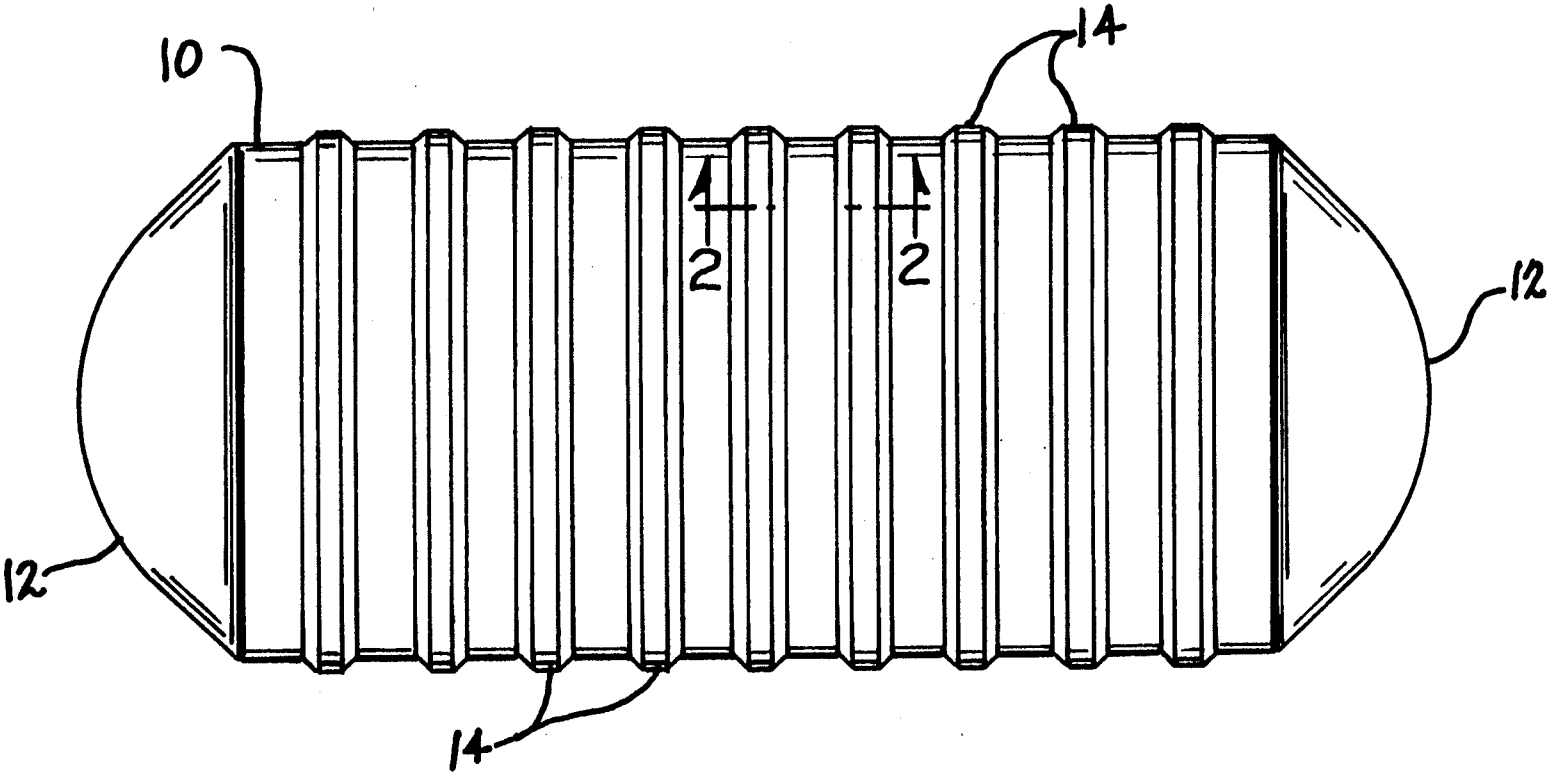
FIG. 1 is an elevational view of a double wall underground tank constructed in accordance with the invention.

As shown in FIG. 1, tank 10 includes end caps 12 and a plurality of ribs 14 which surround the generally cylindrical tank.

Figure 2:
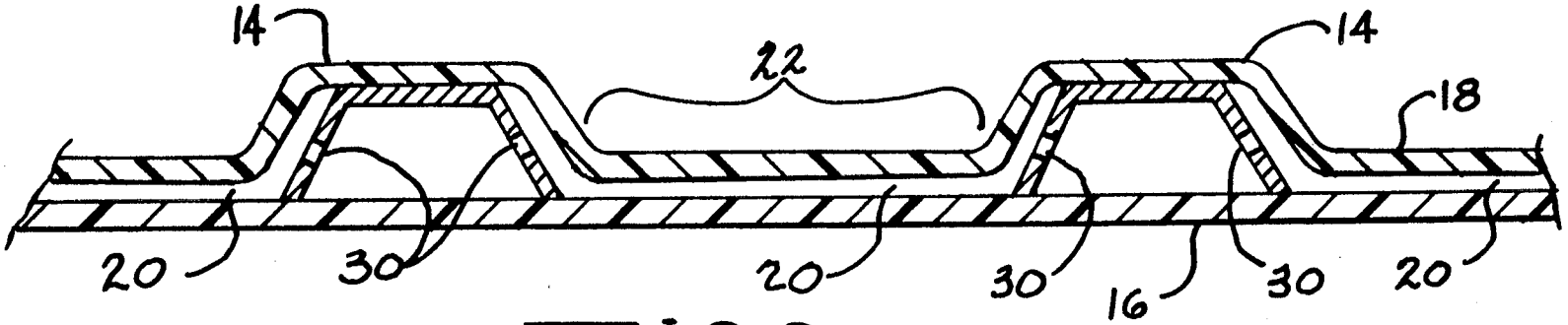
FIG. 2 is a cross-sectional view of two ribs and the inner and outer tank walls taken generally along lines 2—2 of FIG. 1.

As shown in FIG. 2, the tank walls are comprised of inner wall 16 and outer wall 18. The two walls define a void space or annular space 20. The annular space is suitable for receiving a leak detecting fluid, the level of which can be monitored by the operators of the underground storage tank to detect leaks in the tank. Such leak detecting fluids are commercially available, and are well known in the art. It is to be understood that the leak detecting fluid can be a liquid or a gas, such as air. When a gas is used as the leak detecting fluid, a liquid-sensing device is usually placed at the bottom or the lowest point in the annular space to detect the presence of any foreign liquid, whether from within the tank or from outside the tank.

As shown, the outer wall of the tank conforms generally to the contour of the ribs and inner wall. Those portions of the outer wall which are between ribs, such as outer wall portion 22, are in close proximity to the inner wall, and are generally parallel to the inner wall.

Figure 3:
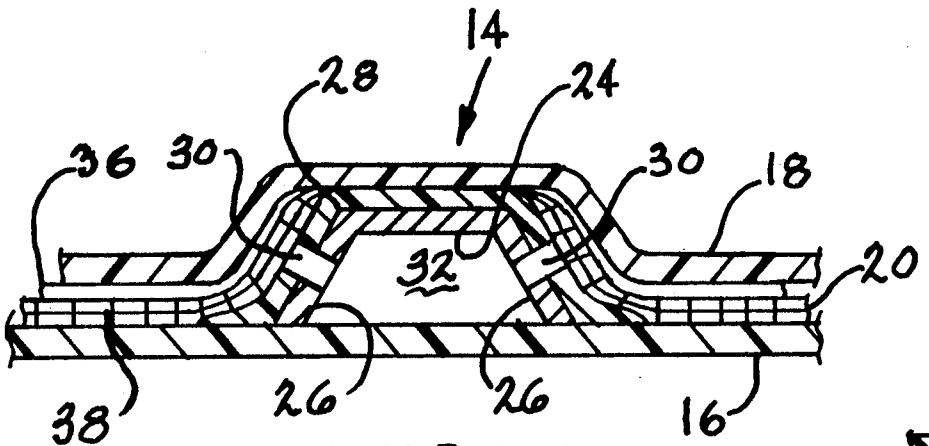
FIG. 3 is a fragmentary enlarged sectional view of one of the ribs of FIG. 2.

As shown in FIG. 3, the rib is comprised of rib top wall 24 and rib sidewalls 26. A rib form commonly used in the industry is a trapezoidal rib form, resulting in a relatively sharp corner 28 where the rib sidewall meets the rib top wall. As shown, the ribs are adapted with flow holes 30, which enable the leak detecting fluid to flow between the rib interior 32 and the annular space. The flow holes can be any means for providing communication with the annular space so that level changes in the leak detecting fluid can be detected. Preferably, the flow holes occur at 90 degree intervals around each of the ribs. While the flow holes communicate with the annular space, they do not penetrate the outer wall.

The ribs can be constructed in any conventional manner, such as by application of fiberglass and plastic resin to form rib sidewalls and a rib top wall over a cardboard, plastic or metal rib form.

As can be clearly seen, the tank outer wall is attached to the rib top wall, but is not attached to the rib sidewalls. This means that the annular space is positioned all along the rib sidewalls. This feature provides the added advantage that leaks in the rib sidewall are still contained by the outer wall.

In order to be more nearly certain that the inner tank wall and the outer tank wall are separated, thereby creating the annular space, it is preferable to apply a spacing device, such as mat 36, between the inner and outer tank walls. The spacing device can be any layer positioned between the inner and outer layers to maintain a separation between the inner and outer walls. The spacing device must allow the flow of the leak detecting fluid within the annular space. Preferably, the spacing device is a mat consisting of a 40 to 100 mil polyethylene open-weave mesh.

Most preferably, the mat used has a film, such as polytheylene film 38, to help guarantee that the outer wall remains substantially separated from the inner wall. The film is placed on the outside of the mesh to prevent the resin from the outer layer from penetrating the mesh. Preferably, the film is a 1 to 2 mil polyethylene layer. Other elements, such as a mylar layer, would also be suitable for separating the inner and outer tank walls.

Figure 4:
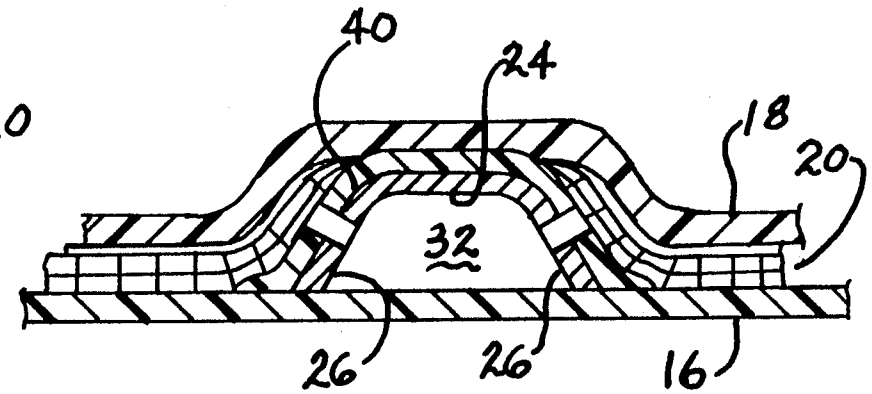
FIG. 4 is a sectional view of a rib of an embodiment of the invention having rounded corners where the rib sidewall meets the rib top wall.

As shown in FIG. 4, the rib can be provided with rounded corners 40 instead of the sharp corners shown in FIG. 3. The advantage of the rounded corner is that it will enable a greater thickness of the fiberglass reinforced resin and thereby eliminate potential weak spots.

Figure 5:
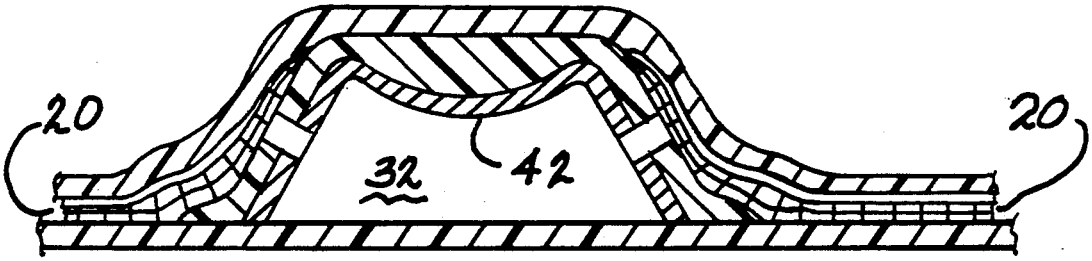
FIG. 5 is a sectional view of another embodiment of the invention in which the rib top wall forms a convex surface in the interior portion of the rib.

As shown in FIG. 5, rib top wall 42 can be provided with a curvature to form a convex surface in the interior of the rib. A convex surface would enable a strengthening of the rib top wall without causing the rib to protrude unduly in height from the tank inner wall.

Figure 6:
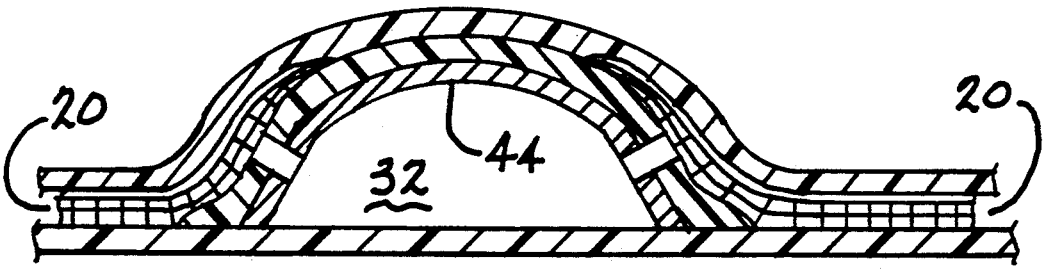
FIG. 6 is a sectional view of another embodiment of the invention in which the rib top wall has a concave surface in the interior portion of the rib.

As shown in FIG. 6, the rib top wall can be made in a curved configuration to provide concave surface 44 for the tank rib interior. This design has the advantage of being relatively easy to construct.

Figure 7:
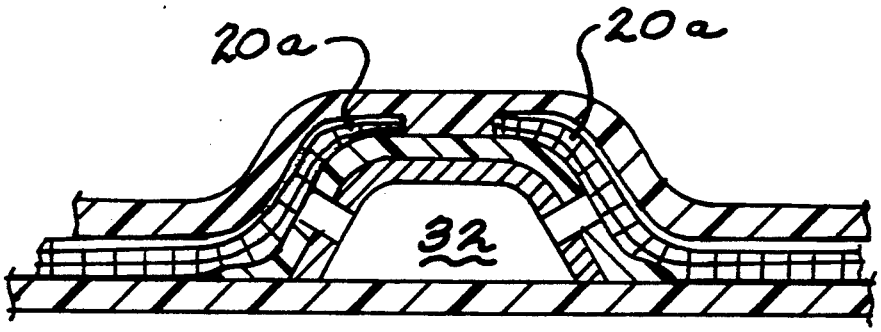
FIG. 7 illustrates another embodiment of the invention in which the annular space extends along the rib sidewalls and part way across the rib top wall.
Figure 8:
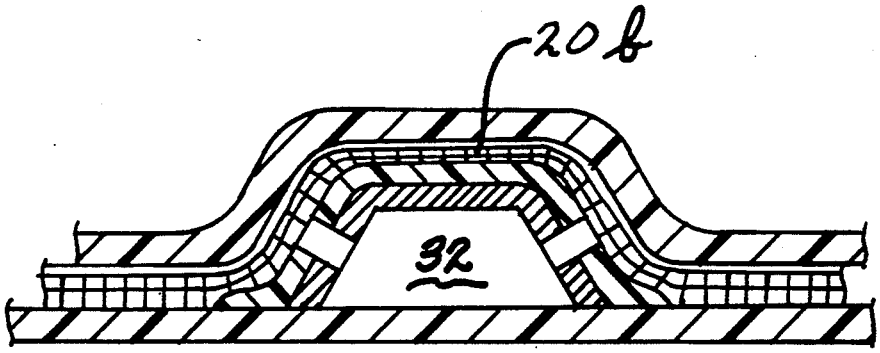
FIG. 8 discloses another embodiment of the invention in which the annular space extends along the rib sidewalls and completely across the rib top wall.

FIG. 7 illustrates an embodiment in which annular space 20*a* not only is directly adjacent to the rib sidewalls, but also partially extends across the rib top wall. As shown in FIG. 8, annular space 20*b* extends completely across the rib top wall. In either case, the outer wall is still attached to the top wall of the rib, but substantially unattached to the sidewalls of the rib.

Various modifications of the above-described embodiments of the invention will be apparent to those skilled in the art, but it is to be understood that such modifications can be made without departing from the scope of the invention.

INDUSTRIAL APPLICABILITY

This invention will be found to be useful in the field of the manufacture of underground storage tanks for the storage of liquids.

I claim:

1. An underground storage tank having an inner wall and an outer wall defining a generally annular space between the inner and outer walls for receiving a leak detecting fluid, and a plurality of ribs bonded to the inner and outer walls and projecting radially outwardly from the inner wall, each rib comprising sidewalls and a top wall, the outer wall being attached to the top wall of each rib but substantially unattached to and spaced from the sidewalls of each rib, and the outer wall substantially conforming to the contour of the inner wall and the ribs.

2. The underground storage tank of claim 1 in which the ribs are hollow, and the interior portions of the ribs are in communication with the annular space.

3. The underground storage tank of claim 2 in which a fibrous mat is positioned between the inner wall and the outer wall, and the annular space has a width substantially equal to the thickness of the mat for those portions of the annular space which are between ribs.

4. The underground storage tank of claim 3 in which a film is attached to one side of the mat.

5. The underground storage tank of claim 3 in which the mat is comprised of polyethylene.

6. The underground storage tank of claim 5 in which the mat is a polyethylene mesh.

7. The underground storage tank of claim 5 in which the film is a polyethylene film.

8. The underground storage tank of claim 3 in which the mat prevents bonding of the inner wall to the outer wall.

9. The underground storage tank of claim 3 in which the annular space has a width substantially equal to the thickness of the mat for those portions of the annular space which are along the rib sidewalls.

10. The underground storage tank of claim 3 in which the rib has rounded corners.

11. The underground storage tank of claim 3 in which the rib has sharp corners.

12. The underground storage tank of claim 3 in which the rib top wall forms a concave surface in the interior portion of the rib.

13. The underground storage tank of claim 3 in which the rib top wall forms a convex surface in the interior portion of the rib.

14. The underground storage tank of claim 3 in which the annular space extends along the rib sidewalls and partway across the rib top wall.

15. The underground storage tank of claim 3 in which the annular space extends along the rib sidewalls and completely across the rib top wall.

16. An underground storage tank having an inner wall and an outer wall defining a generally annular space between the inner and outer walls for receiving a leak detecting fluid, and a plurality of ribs bonded to the inner and outer walls and projecting radially outwardly from the inner wall, each rib comprising sidewalls and a top wall, the ribs being hollow with the interior portions of the ribs being in communication with the annular space, the outer wall being attached to the top wall of each rib but substantially unattached to and spaced from the sidewalls of each rib, and the outer wall substantially conforming to the contour of the inner wall and the ribs, and further comprising a fibrous mat positioned between the inner wall and the outer wall.

17. The underground storage tank of claim 16 in which the mat substantially prevents bonding of the inner wall to the outer wall.

18. The underground storage tank of claim 17 in which a film is attached to one side of the mat.

19. The underground storage tank of claim 18 in which the annular space extends along the rib sidewalls and partway across the rib top wall.

20. The underground storage tank of claim 18 in which the annular space extends along the rib sidewalls and completely across the rib top wall.

21. The underground storage tank of claim 18 in which the annular space has a width substantially equal to the thickness of the mat for those portions of the annular space which are between ribs.

22. The underground storage tank of claim 19 in which the annular space has a width substantially equal to the thickness of the mat for those portions of the annular space which are along the rib sidewalls.

* * * * *